US008366886B2

(12) United States Patent
Tanaka et al.

(10) Patent No.: US 8,366,886 B2
(45) Date of Patent: Feb. 5, 2013

(54) FLUOROGAS GENERATOR

(75) Inventors: Noriyuki Tanaka, Osaka (JP); Osamu Yoshimoto, Osaka (JP); Jiro Hiraiwa, Osaka (JP); Hiroshi Hayakawa, Osaka (JP); Tetsuro Tojo, Osaka (JP)

(73) Assignee: Toyo Tanso Co., Ltd., Osaka-shi (JP)

( * ) Notice: Subject to any disclaimer, the term of this patent is extended or adjusted under 35 U.S.C. 154(b) by 699 days.

(21) Appl. No.: 12/064,704

(22) PCT Filed: Jun. 28, 2006

(86) PCT No.: PCT/JP2006/312866
§ 371 (c)(1),
(2), (4) Date: Apr. 1, 2008

(87) PCT Pub. No.: WO2007/023615
PCT Pub. Date: Mar. 1, 2007

(65) Prior Publication Data

US 2009/0260981 A1 Oct. 22, 2009

(30) Foreign Application Priority Data

Aug. 25, 2005 (JP) ..... 2005-244374

(51) Int. Cl.
*C25B 1/24* (2006.01)
*C25B 9/00* (2006.01)

(52) U.S. Cl. ..... 204/245; 204/247; 205/359

(58) Field of Classification Search ..... 204/243.1, 204/257, 245–247; 205/619, 354–411
See application file for complete search history.

(56) References Cited

U.S. PATENT DOCUMENTS 2,951,021 A * 8/1960 Di Pietro ..... 205/349
5,628,894 A 5/1997 Tarancon
6,818,105 B2 * 11/2004 Tojo et al. ..... 204/240

(Continued)

FOREIGN PATENT DOCUMENTS

EP 0 852 267 A2 7/1998
JP 2 232386 9/1990

(Continued)

OTHER PUBLICATIONS

Extended European Search Report issued Jun. 30, 2011, in Patent Application No. 06767483.8.

(Continued)

*Primary Examiner* — Jonathan Johnson
*Assistant Examiner* — Ciel Thomas
(74) *Attorney, Agent, or Firm* — Oblon, Spivak, McClelland, Maier & Neustadt, L.L.P.

(57) ABSTRACT

A fluorine/fluoride gas generator which has an electrolyte made of mixed molten salt containing hydrogen fluoride in an electrolytic cell including an anode chamber and a cathode chamber, and generates a gas containing fluorine by electrolyzing the electrolyte, includes a raw material supply pipe for supplying an electrolysis raw material, reaching the inside of the electrolyte in the electrolytic cell, a normally-closed valve provided in the middle of the raw material supply pipe, and a bypass pipe provided with a normally-open valve, joining the raw material supply pipe on the downstream side from the normally-closed valve to a gas phase area of the electrolytic cell. Accordingly, the electrolyte is prevented from being suctioned into the raw material supply pipe in the fluorine/fluoride gas generator, and solidification of the electrolyte inside the raw material supply pipe can be prevented.

8 Claims, 3 Drawing Sheets

U.S. PATENT DOCUMENTS

| | | | | |
|---|---|---|---|---|
| 2003/0047445 | A1 | 3/2003 | Tojo et al. | |
| 2004/0007457 | A1 | 1/2004 | Tojo et al. | |
| 2004/0055874 | A1 * | 3/2004 | Hiraiwa et al. | 204/250 |
| 2004/0099537 | A1 * | 5/2004 | Hiraiwa et al. | 205/411 |
| 2004/0108201 | A1 | 6/2004 | Tojo et al. | |

FOREIGN PATENT DOCUMENTS

| | | | |
|---|---|---|---|
| JP | 2-232386 | | 9/1990 |
| JP | 9 505853 | | 6/1997 |
| JP | 2002 339090 | | 11/2002 |
| JP | 2004 43885 | | 2/2004 |
| JP | 2004 52105 | | 2/2004 |
| JP | 3527735 | | 2/2004 |
| JP | 2005 97667 | | 4/2005 |
| WO | WO 2004/007802 | A2 | 1/2004 |
| WO | WO 2005/031039 | A2 | 4/2005 |

OTHER PUBLICATIONS

Office Action dated Aug. 13, 2012 in Taiwan Patent Application No. 095124690 (with English-language Translation).

* cited by examiner

FLUOROGAS GENERATOR

TECHNICAL FIELD

The present invention relates to a gas generator for generating a fluorine-based gas, having a raw material supply system, which can be safely stopped even in the case of emergency stop such as a sudden power cut.

BACKGROUND ART

Normally, a fluorine-based gas is generated by an electrolytic cell 1 of a fluorine/fluoride gas generator as shown in the schematic view of FIG. 1. As the material of the electrolytic cell 1, Ni, monel metal, and carbon steel, etc., are used. The inside of the electrolytic cell 1 is filled with potassium fluoride-hydrogen fluoride or ammonium fluoride-hydrogen fluoride mixed molten salt as an electrolyte 2. The mixed molten salt to be used as the electrolyte 2 has a melting point higher than the ambient temperature, and the normal electrolytic cell 1 for generating fluorine-based gas has a heating device 12 (temperature adjusting means) such as a heater or a hot water pipe, etc., on its outer peripheral portion. The melting point of the mixed molten salt to be used for the electrolyte is, for example, approximately 70 degrees C. (KF-2HF) or approximately 50 degrees C. ($NH_4F$-2HF)

The electrolytic cell 1 is divided into an anode chamber 3 and a cathode chamber 4 by a partition 16 made of monel metal or the like. By the electrolysis, as a result of applying a voltage between a carbon or nickel (hereinafter, referred to as Ni) anode 51 housed in the anode chamber 3 and an Ni cathode 52 housed in the cathode chamber 4, a fluorine-based gas is generated in the anode chamber 3 side, and hydrogen gas is generated in the cathode chamber 4 side. The generated fluorine-based gas is exhausted from a fluorine-based gas exhaust port 22, and the hydrogen gas generated in the cathode chamber 4 side is exhausted from a hydrogen gas exhaust port 23. By the electrolysis, the electrolysis raw material is reduced. In the case of a potassium fluoride-hydrogen fluoride electrolyte, according to electrolysis, hydrogen fluoride (hereinafter, referred to as HF) is consumed and the electrolyte liquid level lowers. At this time, from a raw material gas supply port 26 extending from the outside of the electrolytic cell 1 1 to the inside of the electrolyte 2 of the cathode chamber, an HF gas as a raw material gas is directly supplied into the electrolyte 2. HF has a boiling point of approximately 20 degrees C., and it is supplied in the form of gas to the gas generator, so that the raw material gas supply pipe 25 must be heated to approximately 35 to 40 degrees C., and it has a temperature adjusting means. Similarly, in the case of an ammonium fluoride-hydrogen fluoride electrolyte, when the liquid level lowers according to electrolysis, HF gas and $NH_3$ gas are directly supplied into the electrolyte 2 from the raw material gas supply pipe 25 extending from the outside of the electrolytic cell 1 into the electrolyte 2 of the cathode chamber and an ammonia (hereinafter, referred to as $NH_3$) gas supply pipe with the same constitution as that of the HF gas supply pipe although this is not shown. The supply of the HF gas and $NH_3$ gas is interlocked with liquid level detection sensors 5 and 6 which monitor the height of the level of the electrolyte 2 so as to maintain a constant liquid level.

As the above-described gas generator, for example, one is disclosed in Patent document 1 listed below.

In the above-described fluorine/fluoride gas generator, when the supply of the raw material gas from the raw material gas supply pipe 25 is stopped due to emergency stop such as a sudden power cut, the raw material gas remaining in the pipe quickly dissolves into the electrolyte 2, so that the inside of the raw material supply pipe 25 leading to the cathode chamber 4 is decompressed. The electrolyte 2 is low in viscosity in a molten state, and it is suctioned to the inside of the raw material gas supply pipe 25 via the raw material gas supply port 26. The heating condition of the heater 24 attached to the raw material gas supply pipe 25 is 35 to 40 degrees C., and this is lower than the melting point of 50 to 70 degrees C. of the electrolyte 2, so that the ingredients of the electrolyte 2 that have entered inside the raw material gas supply pipe 25 are cooled and solidified. The whole raw material gas supply pipe 25 clogged by the solidification of the ingredients of the electrolyte 2 must be replaced, however, this replacement is dangerous, and time and cost are necessary to recover the generator.

The melting point of potassium fluoride-hydrogen fluoride or ammonium fluoride-hydrogen fluoride mixed molten salt fluctuates according to the relative proportions of the ingredients. Particularly, mixed molten salt for an electrolyte to be generally used for generating fluorine is KF-2HF, and its melting point is 70 degrees C. In detail, the ratio of HF to KF in the electrolyte is controlled in the range of 1.9 to 2.3. Herein, at an HF concentration lower than a lower limit of KF-1.9HF, the melting point of the electrolyte suddenly rises and exceeds 100 degrees C. When the melting point is over the control capability of the gas generator, the molten state of the electrolyte cannot be maintained, and as a result, electrolysis cannot be performed, and the gas generator fails. At an HF concentration over an upper limit of KF-2.3HF, the melting point of the electrolyte lowers, however, the carbon-made anode collapses, and if HF increases, the gas generator corrodes. In both of these cases, stable gas supply cannot be performed. In consideration of these facts, to operate the gas generator without problems, stable supply of the raw material gas to the electrolyte must be continued.

As a method for solving the problem of clogging of the raw material gas supply pipe with the electrolyte in Patent document 1, for example, there is proposed a method described in Patent document 2 listed below. In detail, as shown in FIG. 2, the raw material gas supply pipe 25 is provided with a nitrogen gas supply pipe 40 and various members for controlling the flow in the nitrogen gas supply pipe 40. First, nitrogen to be supplied to the nitrogen supply pipe 40 is adjusted in pressure by a decompression valve 46, and temporarily stored in a nitrogen tank 44 through an automatic valve 45. Nitrogen stored in the nitrogen tank 44 is adjusted in pressure again by a decompression valve 43 and adjusted in flow rate by a flowmeter 42 in the nitrogen supply pipe 40, and then supplied to the raw material gas supply pipe 25 through an automatic valve 41. As for operations in detail, first, when liquid level detection sensors 5 and 6 which are installed inside the electrolytic cell 1 and monitor the liquid level of the electrolyte 2 detect a liquid level lower than a reference, an automatic valve 81 opens and supplies the raw material gas to the raw material gas supply pipe 25, and at this time, the automatic valve 41 does not open and nitrogen gas does not flow. When the liquid level detection sensors 5 and 6 which are installed inside the electrolytic cell 1 and monitor the liquid level of the electrolyte 2 detect a liquid level rise to the reference, the automatic valve 81 closes and the raw material gas inside the raw material gas supply pipe 25 is not supplied. At this time, when the raw material gas remains inside the raw material gas supply pipe 25, it quickly dissolves into the electrolyte 2, so that the inside of the raw material gas supply pipe 25 leading to the cathode chamber 4 is decompressed. The electrolyte 2 is low in viscosity in a molten state, and it is suctioned to the inside of the raw material gas supply pipe 25 via the raw material gas supply port 26. The heating condition of the heater 24 attached to the raw material gas supply pipe 25 is 35 to 40 degrees C., and this is lower than the melting point of 50 to 70 degrees C. of the electrolyte 2, so that a part of the electrolyte 2 that has entered inside the raw material gas supply pipe 25 is cooled and solidified. To prevent this suctioning of the electrolyte 2, the automatic valve 41 is opened and nitrogen gas is supplied into the raw material gas supply pipe 25 to wash out all raw material gas remaining inside the raw material gas supply pipe 25 into the electrolyte 2, whereby the inside of the raw material gas supply pipe 25 is cleaned.

Patent document 1: Published Japanese Translations of PCT International Publication for Patent Application No. 9-505853

Patent document 2: Japanese Patent Publication No. 3527735

DISCLOSURE OF INVENTION

Problem to be Solved by the Invention

In the gas generator which generates a fluorine-based gas, when the power is suddenly cut during supply of the raw material gas, or the pipe inside the gas generator is clogged, and, a person finds gas leakage or other abnormalities and operates an EMO (emergency stop) button that is not shown, or a sequencer determines the temperature, pressure, or liquid level as being abnormal to an extent equivalent to EMO, the gas generator may be emergency-stopped. In detail, (1) the power source (electricity) is cut off, (2) all automatic valves (in FIG. 2, 45 on the nitrogen gas supply pipe 40, 81 on the raw material gas supply pipe 25, 89 at the hydrogen gas exhaust port 23, 91 at the fluorine gas exhaust port 22, and other automatic valves in not-shown pipes leading to the generator) of the primary side and secondary side pipes of the gas generator of FIG. 2 are closed to cut gas connection to the outside so that the gas generator is sealed up. From this state, unless a person operates the gas generator to release the emergency stop state, the gas generator cannot be restored to a normal automatic operating state. The automatic valves mentioned herein are valves such as solenoid valves and air pressure values which are opened and closed in response to an electric signal from the outside or gas pressure.

At the time of this EMO, in the normal combination of only the nitrogen gas supply pipe 40 and the automatic valve 41 excluding the nitrogen tank 44, the automatic valve 45, and the decompression valve 46 of FIG. 2, the nitrogen gas cannot be supplied to the raw material gas supply pipe 25, and if the raw material gas remains inside the raw material gas supply pipe 25, the raw material gas easily dissolves into the electrolyte 2 and the inside of the supply pipe is decompressed, and the electrolyte 2 is suctioned.

However, in the gas generator of FIG. 2 representatively described in Patent document 2, by using the gas pressure stored in the nitrogen tank 44 provided on the nitrogen gas supply pipe 40, nitrogen is supplied for a predetermined time at a constant flow rate into the raw material gas supply pipe 25 to forcibly wash out the raw material gas inside the raw material gas supply pipe 25 to the electrolyte 2, whereby suctioning and solidification of the electrolyte 2 to the inside of the raw material gas supply pipe 25 can be prevented.

However, in the gas generator of FIG. 2, members including the nitrogen tank 44 and the decompression valve 46, etc., are necessary on the nitrogen gas supply pipe 40, and the piping becomes complicated.

At the time of EMO, nitrogen is forcibly supplied into the cathode chamber 4, so that the inside of the cathode chamber 4 after EMO is pressurized and the liquid level in the electrolytic cell becomes imbalanced. When trying to recover the gas generator, due to this liquid level imbalance, abnormality detection and EMO are repeated, and nitrogen gas may be frequently introduced into the cathode chamber 4 from the nitrogen tank 44.

These will be described by using detailed examples as follows. In the gas generator of FIG. 2 after EMO, the electrolytic cell 1 is sealed up for insulation from the outside. In this state, for example, when the nitrogen gas is allowed to flow for 30 minutes at 200 cc/min as a cleaning condition for the raw material supply pipe, a total of 6 liters of nitrogen per one EMO is compressed into the cathode chamber 4. The size of the electrolytic cell 1 varies depending on the fluorine gas generating amount, however, as an example, when it is assumed that the electrolytic cell has a 100 A capacity and a space of approximately 60 liters is in the cathode chamber 4, if 6 liters of nitrogen gas is compressed into the space, the pressure increases simply by 10 percent. Then, if this pressure difference causes the liquid level imbalance, and EMO occurs again for some reason, further imbalance of the liquid level is added, and the gas generator cannot be easily restarted.

The present invention was made in view of the above-described problems, and an object thereof is to provide a fluorine/fluoride gas generator which is improved in safety by preventing suctioning of electrolyte into the raw material supply pipe and solidification of the electrolyte by suppressing decompression inside the raw material supply pipe at the time of operation stop or stop of supply of a raw material such as HF or $NH_3$, etc., due to abnormalities while the constitution of the gas generator is simple.

Means for Solving the Problems and Effects Thereof

The present invention relates to a gas generator which has an electrolyte made of mixed molten salt containing hydrogen fluoride or ammonium salt in an electrolytic cell including an anode chamber and a cathode chamber, and generates a fluorine-based gas (for example, fluorine or nitrogen trifluoride) by electrolyzing the electrolyte, equipped with a raw material supply system which includes a raw material supply pipe for supplying an electrolysis raw material, reaching the inside of the electrolyte in the electrolytic cell, a normally-closed valve provided in the middle of the raw material supply pipe, and a bypass pipe provided with a normally-open valve, joining the raw material supply pipe on the downstream side from the normally-closed valve to a gas phase area of the electrolytic cell. In the fluorine/fluoride gas generator of the present invention, it is preferable that the raw material supply pipe is provided on the cathode chamber side of the electrolytic cell. In the fluorine/fluoride gas generator of the present invention, it is preferable that even when the normally-closed valve of the raw material supply pipe is closed and the raw material supply is stopped, or when the gas generator is emergency-stopped during supply of the raw material, the normally-open valve opens to balance the pressure inside the raw material supply pipe and the pressure inside the electrolytic cell. The normally-closed valve mentioned herein means an automatic valve which is closed in a natural state, and opens in response to an electric signal from the outside or a gas pressure if necessary, and the normally-open valve means an automatic valve which is open in a natural state, and closes in response to an electric signal from the outside or a gas pressure if necessary.

With the above-described constitution, even when an abnormality occurs during supply of the raw material and the gas generator function stops and the supply of the raw material stops, the automatic valve of the bypass pipe opens concurrently, so that even if the raw material remaining inside the raw material supply pipe dissolves into the electrolyte and the inside of the raw material supply pipe is decompressed, the atmosphere gas immediately flows into the raw material supply pipe from the gas phase area of the electrolytic cell through the bypass pipe, so that the pressure inside the raw material supply pipe does not apparently decrease. Accordingly, with the simple constitution, even if an abnormality occurs during operation of the gas generator and the gas generator function stops, the pressure fluctuation inside the raw material supply pipe can be suppressed, and the pipe can be prevented from being clogged due to suctioning and solidification of the electrolyte into the raw material supply pipe.

In the present invention, it is preferable that a nitrogen gas supply pipe for supplying a nitrogen gas is further connected to the raw material supply pipe between the normally-closed valve of the raw material supply pipe and the normally-open valve of the bypass pipe.

With the above-described constitution, by always supplying a small amount of nitrogen gas into the raw material supply pipe, HF remaining inside the raw material supply pipe can be washed out, so that clogging of the pipe due to suctioning and solidification of the electrolyte into the raw material supply pipe can be further prevented.

Best Mode for Carrying Out the Invention

Hereinafter, an embodiment of the fluorine/fluoride gas generator of the present invention will be described. In the description given below of the embodiment, the portions similar to the portions of the gas generator described in Background Art above are attached with the same reference numerals, and description thereof may be omitted.

FIG. 3 is a schematic view of a main portion of the fluorine gas generator of an embodiment of the present invention. In FIG. 3, the reference numeral 1 denotes an electrolytic cell, 2 denotes an electrolyte made of KF—HF mixed molten salt, 3 denotes an anode chamber, and 4 denotes a cathode chamber. The reference numeral 5 denotes a first liquid level detecting means for detecting a liquid level of the anode chamber. The reference numeral 6 denotes a second liquid level detecting means for detecting a liquid level of the cathode chamber. The reference numeral 11 denotes a temperature gauge for measuring the temperature of the electrolyte 2, and 12 denotes a hot water jacket for heating and melting the electrolyte 2 on the outer periphery of the electrolytic cell 1 and a heating device (temperature adjusting means) leading to the hot water jacket. The reference numeral 22 denotes a generation port for fluorine gas generated from the anode chamber 3, and inside this, an automatic valve 91 for shutting-off in the case of EMO is provided. The reference numeral 23 denotes a generation port for hydrogen gas generated from the cathode chamber 4, and an automatic valve 89 for shutting-off in the case of EMO is provided ahead of it. The reference numeral 25 denotes a HF supply pipe for supplying HF to the electrolytic cell 1. The reference numeral 80 denotes a bypass as a bypass pipe. The reference numeral 81 denotes an automatic valve disposed in the HF supply pipe, 82 denotes an automatic valve disposed in the bypass 80, and 83 denotes a flowmeter which monitors a flow rate of HF passing through the HF supply pipe 25. The reference numeral 84 denotes a pressure gauge for measuring the pressure of HF. The bypass 80 joins the raw material gas supply pipe 25 and the gas phase area of the cathode chamber 4 of the electrolytic cell 1. The reference numeral 14 denotes a removing tower for removing HF from the hydrogen-HF mixed gas exhausted from the cathode chamber 4. The removing tower 14 can be used at the front or the rear of the automatic valve 89 in the present invention. The reference numeral 15 denotes an HF removing tower which separates a fluorine gas by removing only HF from the fluorine-HF mixed gas exhausted from the anode chamber 3. The HF removing tower 15 can be used at the front or the rear of the automatic valve 91 in this embodiment.

Further, although not shown, the gas generator is equipped with an HF supply stop detecting device (detecting means) which detects HF supply stop, and the automatic valve 81, the automatic valve 82, and the HF supply stop detecting device constitute an HF pipe clogging preventive means.

The electrolytic cell 1 is made of a metal such as Ni, monel metal, pure iron, or stainless steel, or an alloy. The electrolytic cell 1 is divided into an anode chamber 3 and a cathode chamber 4 by a partition 16 made of Ni or monel metal. In the anode chamber 3, an anode 51 is disposed. In the cathode chamber 4, a cathode 52 is provided. It is preferable that a low-polarizability carbon electrode is used for the anode. As the cathode, Ni or iron, etc., is preferably used.

The heating device 12 (temperature adjusting means) can detect the temperature measured by the temperature gauge 11, and can adjust it to a desired electrolyte temperature. Accordingly, for example the electrolyte 2 can be heated to 85 to 90 degrees C. and maintained in a molten state. If it is difficult to control the temperature by only the hot water jacket, an electric heater may be complementarily used. It is also allowed that the electrolyte 2 is melted only by the electric heater if the heat capacity of the electric heater is the same.

In an upper cover 17 of the electrolytic cell 1, a purge gas port from a gas pipe that is not shown as one of the pressure maintaining means for maintaining the insides of the anode chamber 3 and the cathode chamber 4 at the atmosphere pressure, a fluorine gas exhaust port 22 from which fluorine gas generated from the anode chamber 3 is exhausted, and a hydrogen gas exhaust port 23 for exhausting hydrogen gas generated from the cathode chamber 4, are provided. The upper cover 17 is provided with a first liquid level detection sensor 5 and a second liquid level detection sensor 6.

The raw material gas supply pipe 25 is connected to an HF supply source outside the gas generator, and extends from this connecting portion to the raw material gas supply port 26 disposed in the cathode chamber 4 of the electrolytic cell 1. The raw material gas supply pipe 25 is covered with a temperature adjusting heater 24 for supplying HF in a gas phase, and is heated in the range of 35 to 40 degrees C. The raw material gas supply pipe 25 is provided with, in order from the upstream side to the downstream side, a manual valve 66, a pressure gauge 31, a pressure gauge 34, a flowmeter 83, the automatic valve 81, and a pressure gauge 84, and a bypass 80 is provided for the raw material gas supply pipe 25 between the automatic valve 81 and the pressure gauge 84 and communicates with the cathode chamber 4, and in the middle of the bypass 80, an automatic valve 82 is disposed. The pressure gauge 84 can be disposed at either the front or rear of the bypass pipe 80 as long as it is on the secondary side of the automatic valve 81.

The automatic valve 81 opens so as to supply HF to the electrolyte 2 when the first liquid level detection sensor 5 and the second liquid level detection sensor 6 detect liquid level lowering of the electrolyte 2. The automatic valve 82 opens and closes in conjunction with the HF supply stop detecting device not shown to balance the pressure inside the raw material gas supply pipe 25 with respect to the electrolytic cell 1. The flowmeter 83 monitors the flow rate of HF supplied into the electrolytic cell 1 via the raw material gas supply pipe 25.

Next, an operation for supplying HF to the electrolyte 2 at the time of normal operation of the gas generator of this embodiment will be described. According to electrolysis, as reaction within the electrolyte 2 progresses, a fluorine gas is obtained, and at the same time, HF in the electrolyte 2 is consumed. Consumption of the electrolyte 2 is detected by monitoring the liquid level lowering of the electrolyte 2 by the first liquid level detection sensor 5 and the second liquid level detection sensor 6. When liquid level lowering of the electrolyte 2 is detected, the automatic valve 81 in the raw material gas supply pipe 25 opens to supply HF. The amount of HF supplied to the electrolyte 2 is measured by the flowmeter 83. Then, when the electrolyte 2 increases to a regulated amount or more according to the supply of HF, this is detected by an HF supply stopping device that is not shown via the first liquid level detection sensor 5 and the second liquid level detection sensor 6, and an operation for stopping the HF supply is performed. The manual valve 66 is left open, and the pressure gauges 31, 34, and 84 are provided for monitoring the HF distribution state by pressure.

Next, operations of the gas generator in the case of EMO will be described. In the gas generator, an EMO operation in the case where an abnormality occurs is performed when a power cut occurs or some abnormality occurs in the gas generator and a person finds this and operates the EMO (emergency stop) button, or in response to a command issued when a control device 100 detects an abnormality. In detail, all automatic valves (81 in the raw material gas supply pipe 25, 41 in the nitrogen supply pipe 40, 89 in the hydrogen gas exhaust port 23, and 91 in the fluorine gas exhaust port 22 in FIG. 3) of the gas generator are closed, and the automatic valve 82 in the bypass 80 is opened instead. Accordingly, when HF gas remains inside the raw material gas supply pipe 25, even if the gas dissolves into the electrolyte 2 and causes decompression, the same pressure as in the cathode chamber 4 can be maintained by the bypass 80. In addition, the pressure inside the raw material gas supply pipe 25 in this case can be monitored by the pressure gauge 84.

After EMO-stop, it may take a long time to remove the cause of the EMO stop and secure safety, and after this, it is preferable that the gas generator is restarted as quickly as possible. In the conventional method, when the pipe is clogged, the members must be replaced, and when nitrogen gas is introduced into the raw material gas supply pipe 25 or the cathode chamber 4, the pressure fluctuation must be eliminated and a secondary accident from pressurization must be considered.

In the present invention, in consideration of safety in the case of an emergency stop, it is preferable that the automatic valve 81 disposed in the raw material gas supply pipe 25 is a normally-closed type, and the automatic valve 82 disposed in the bypass 80 is a normally-open type. With this constitution, even in the case of an emergency stop that makes it impossible to secure a power source such as in the case of an earthquake or a power cut, the above-described operations as the gas generator can be automatically performed, so that decompression inside the raw material gas supply pipe 25 due to dissolving of the raw material gas (HF gas) inside the raw material gas supply pipe 25 into the electrolyte 2 and clogging due to backflow and solidification of the electrolyte 2 can be prevented, and imbalance of the liquid level in the electrolytic cell according to nitrogen gas introduction into the cathode chamber can also be prevented, so that the gas generator can be safely and stably stopped.

This embodiment brings about the following effect. That is, when the raw material gas supply to the gas generator is suddenly stopped, the raw material gas may remain inside the raw material gas supply pipe 25, and thereafter, this raw material gas dissolves into the electrolyte 2 and the inside of the raw material gas supply pipe 25 tends to be decompressed. At this time, through the bypass 80 with the automatic valve 82 open, the atmosphere gas immediately flows into the raw material gas supply pipe 25 from the gas phase area of the cathode chamber 4, so that the pressure inside the raw material gas supply pipe 25 is not apparently decompressed, and as a result, the raw material gas supply pipe 25 can be prevented from being clogged by backflow or solidification of the electrolyte 2 into the raw material gas supply pipe 25. According to this raw material gas supply system, a gas generator which can prevent imbalance of the liquid level in the electrolytic cell 1 and backflow and solidification of the electrolyte 2 into the raw material gas supply pipe 25 with a simplified constitution than that of the conventional fluorine/fluoride gas generator can be provided.

In addition, the automatic valve 82 can be replaced with a check valve. When HF flows in the raw material gas supply pipe 25, the valve closes and nothing flows into the bypass 80. The function of the check valve is equivalent to that of the automatic valve as long as it can supply a gas which can compensate decompression caused by dissolving of HF into the electrolyte 2 when the HF supply to the raw material gas supply pipe 25 stops, to the raw material gas supply pipe 25 from the cathode chamber 4 through the bypass 80.

According to this embodiment, operations in the case of EMO in the gas generator are definitely effective, however, measures after the HF supply operation stops are also effective. Specifically, in the gas generator of this embodiment, in the case of an emergency stop or supply stop of the raw material gas, even if the raw material gas remaining inside the raw material gas supply pipe 25 dissolves into the electrolyte 2 and the inside of the raw material gas supply pipe 25 tends to be decompressed, the atmosphere gas immediately flows into the raw material gas supply pipe 25 from the gas phase area of the cathode chamber 4 through the bypass, so that the pressure inside the raw material gas supply pipe 25 is not apparently decompressed, and as a result, the raw material gas supply pipe 25 can be prevented from being clogged by backflow or solidification of the electrolyte 2 into the raw material gas supply pipe 25.

In this embodiment, the pipe 40 for supplying nitrogen gas into the raw material gas supply pipe 25 and members accompanying this pipe in FIG. 2 can be omitted, so that the gas generator can be downsized in manufacturing. Further, to continue the operation, the nitrogen consumption can be reduced more than conventionally, and the number of members to be used in the gas generator is also reduced, so that the maintenance cost can be reduced accordingly.

The gas generator of the embodiment of the present invention is described above, however, the present invention is not limited to the above-described embodiment, and it can be varied within the scope of claims, for example, an $NF_3$ generator involving electrolysis of ammonium fluoride-hydrogen fluoride mixed molten salt is constituted by only adding an $NH_3$ supply pipe to the gas generator described above, and $NH_3$ also quickly dissolves into the electrolyte 2 similar to HF, so that the present invention can be used for preventing clogging of not only the raw material supply pipe but also the $NH_3$ supply pipe.

In addition, the raw material supply system of the present invention is definitely effective when HF or $NH_3$ is supplied in the form of gas, and, it is also effective when HF or $NH_3$ is supplied in the form of liquid.

The present invention can be changed in design without departing from the scope of claims, and is not limited to the above-described embodiment.

DESCRIPTION OF REFERENCE NUMERALS

Figure 1:
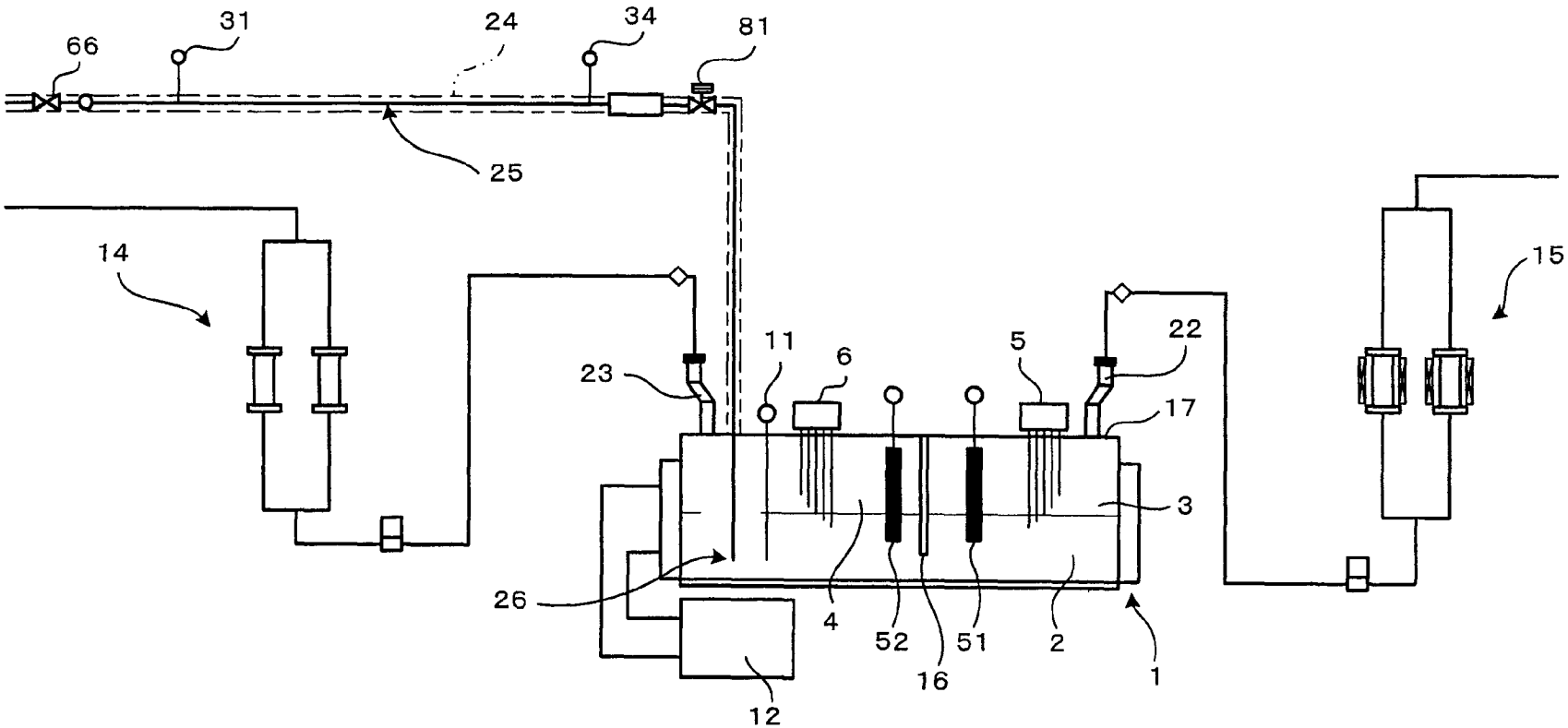
FIG. 1 PRIOR ART
FIG. 1 is a schematic view of a main portion of a conventional gas generator.
Figure 2:
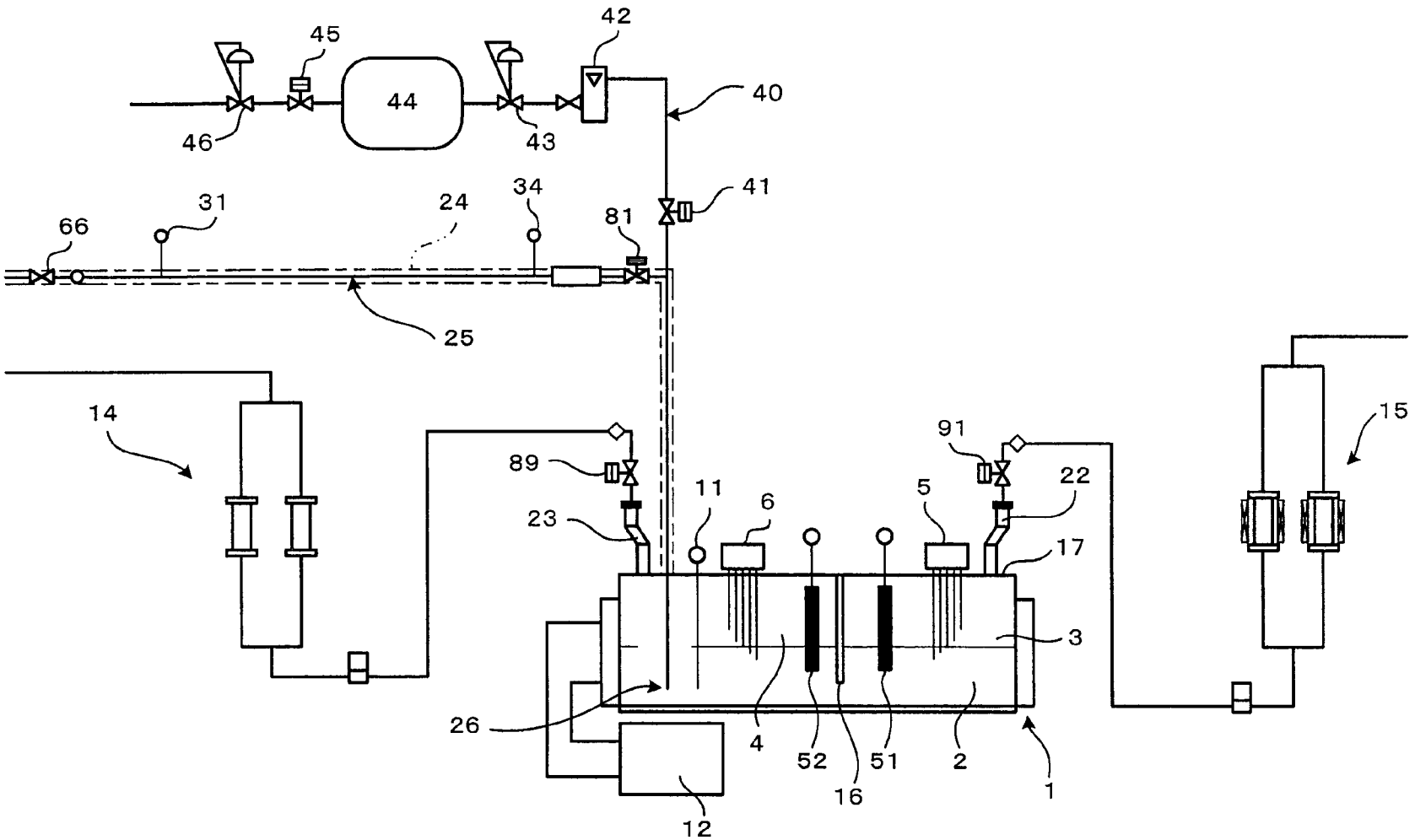
FIG. 2 PRIOR ART
FIG. 2 is a schematic view of a main portion of another conventional gas generator.
Figure 3:
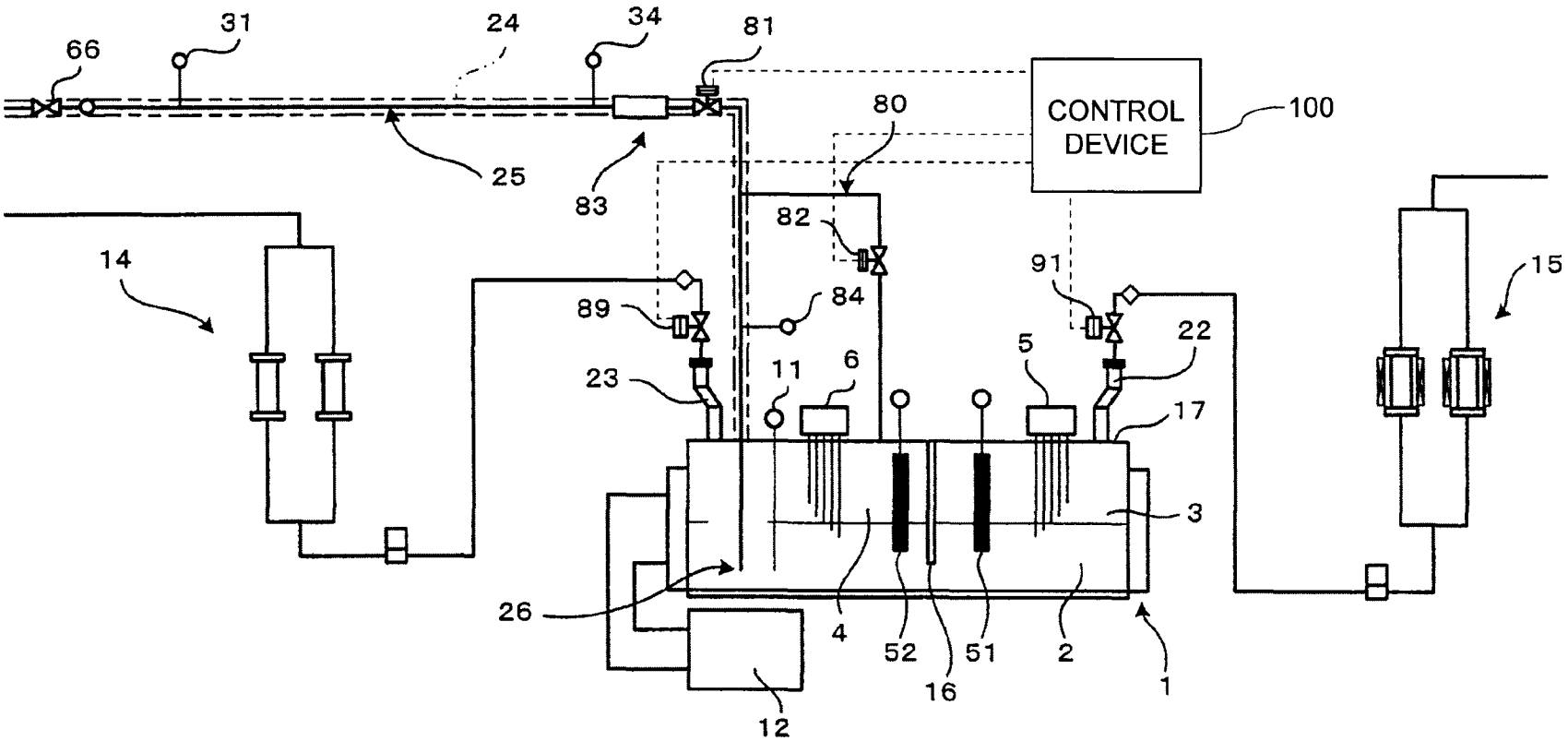
FIG. 3 is a schematic view of a main portion of a gas generator of an embodiment of the present invention.

1 electrolytic cell
2 electrolyte
3 anode chamber
4 cathode chamber
5 first liquid level detection sensor
6 second liquid level detection sensor
41, 45, 81, 82, 89, 91 automatic valve
11 temperature gauge
12 heating device
14, 15 HF removing tower
16 partition
22 fluorine gas exhaust port
23 hydrogen gas exhaust port
24 heater
25 raw material gas supply pipe
26 raw material gas supply port
31, 34, 84 pressure gauge
40 nitrogen gas supply pipe
42, 83 flowmeter
43, 46 decompression valve
44 nitrogen tank
51 anode
52 cathode
66 manual valve
80 bypass

What is claimed is:

1. A fluorine/fluoride gas generator, comprising:

an electrolyte made of mixed molten salt containing hydrogen fluoride in an electrolytic cell including an anode chamber and a cathode chamber, the generator generating a gas containing fluorine by electrolyzing the electrolyte;

a raw material supply pipe that supplies an electrolysis raw material, the pipe reaching an inside of the electrolyte in the electrolytic cell;

a bypass pipe which is branched from a middle of the raw material supply pipe and connects only the middle of the raw material supply pipe to a gas phase area of the electrolytic cell;

a normally-closed valve provided in a middle of the raw material supply pipe and is configured to be closed in a natural state and configured to automatically open in response to an electric signal from the outside or a gas pressure when necessary;

a normally-open valve which is configured to open in a natural state and configured to be automatically closed in response to an electric signal from the outside or a gas pressure when necessary; and the normally-closed valve, on the raw material supply pipe, is provided on an upstream side of a part from which the bypass pipe is branched.

2. The fluorine/fluoride gas generator according to claim 1, wherein the raw material supply pipe is provided on a cathode chamber side of the electrolytic cell.

3. The fluorine/fluoride gas generator according to claim 1 or 2, further comprising a control device, wherein when the normally-closed valve provided in the middle of the raw material supply pipe closes, the control device opens the normally-open valve provided in the middle of the bypass pipe so that the pressure inside the raw material supply pipe and the pressure inside the cathode chamber are balanced.

4. The fluorine/fluoride gas generator according to claim 1 or 2, wherein the electrolytic cell is configured to generate fluorine or nitrogen trifluoride gas.

5. The fluorine/fluoride gas generator according to claim 1, wherein the electrolyte is kept at 85 to 90° C. and in a molten state.

6. The fluorine/fluoride gas generator according to claim 1, wherein the raw material supply pipe is covered with a temperature adjusting heater such that the raw material is supplied in a gas phase.

7. The fluorine/fluoride gas generator according to claim 6, wherein the raw material supply pipe is kept at 35 to 40° C.

8. The fluorine/fluoride gas generator according to claim 1, wherein the bypass pipe is connected to a gas phase area of the cathode chamber.

* * * * *

UNITED STATES PATENT AND TRADEMARK OFFICE

CERTIFICATE OF CORRECTION

PATENT NO. : 8,366,886 B2
APPLICATION NO. : 12/064704
DATED : February 5, 2013
INVENTOR(S) : Tanaka et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 873 days.

Signed and Sealed this
First Day of September, 2015

Michelle K. Lee

Michelle K. Lee
*Director of the United States Patent and Trademark Office*